United States Patent [19]

Fernandez

[11] Patent Number: 4,914,423

[45] Date of Patent: Apr. 3, 1990

[54] POSTURE IMPROVING DEVICE

[76] Inventor: Luis C. Fernandez, 131 Deerfield Dr., Tenafly, N.J. 07670

[21] Appl. No.: 301,246

[22] Filed: Jan. 25, 1989

[51] Int. Cl.[4] ..... G08B 23/00; A61B 5/10

[52] U.S. Cl. ..... 340/573; 128/782; 340/668

[58] Field of Search ..... 340/573, 668; 128/782

[56] References Cited

U.S. PATENT DOCUMENTS 3,670,320 6/1972 Palmer ..... 340/573

4,392,126 7/1983 Loyola ..... 340/573

*Primary Examiner*—Joseph A. Orsino

*Assistant Examiner*—Thomas J. Mullen, Jr.

[57] ABSTRACT

A posture improving waist expansion monitoring device which includes a housing which contains an alarm and sensing mechanism, a one-piece belt fastened at one end of the housing and attached to one of the legs of a four-sided round-wire ring at the other end via a flat hook, the length of the belt being adjustable by means of a slide ring. When the wearer's waist is in a contracted position, there is no alarm since the circuit is not completed; however when the waist is expanded and the belt has been preadjusted such that in this enlarged condition the leaf spring completes the electric circuit and consequently actuating the alarm in the housing.

11 Claims, 1 Drawing Sheet

POSTURE IMPROVING DEVICE

BACKGROUND OF THE INVENTION

1. Field of Invention

This invention relates to belt-like devices that primarily use a mechanical switch and electrical alarm to indicate the expansion of the wearer's waist.

2. Description of the Prior Art

Palmer, in U.S. Pat. No. 3,670,320, uses a separate stand-alone switch which is expensive. While Loyola, in U.S. Pat. No. 4,392,126 does not use an off-the-shelf standard switch like Palmer, it nevertheless uses distinct electrical contacts, one fastened on the housing, the other on a movable leg. Electrical contacts cost and extra steps are required in fastening them to their respective positions and then soldering the hook-up wires to them. This present invention uses neither a standard switch as in Palmer nor the electrical contacts in Loyola, thus this present invention is more economical to manufacture. In addition, Loyola uses a coiled spring for each of the legs for urging the pair of legs and the cross leg which holds the moving electrical contact away from the stationary electrical contact on the housing. This again creates additional assembly and material costs. This present invention, however, uses a simple and inexpensive inexpensive leaf spring to keep the electrical circuit open. Furthermore, Loyola does not provide channels in the substanially hollow housing, but simply apertures at the housing wall, to allow movement of the sliding pair of legs. This present invention provides channels for the reliable movement of the four-sided round-wire ring which holds one end of the belt and detects waist expansion.

SUMMARY OF THE INVENTION

It is the main object of this invention to detect the expansion of the waist of the wearer using a leaf spring switch which is an integral part of the housing which also holds the electronic alarm and the movable four-sided round-wire ring.

It is another object of the invention to provide a thin housing by using microelectronic circuitry and piezoceramic sound transducer.

It is another object of this invention to provide a posture alarm belt which is easy and inexpensive to manufacture by virtue of it having the most minimal number of parts and absence of electrical contacts.

This invention is directed to a waist expansion, posture improvement monitor. It comprises of a leaf spring switch system which is an integral part of the housing which also holds the electronic alarm, battery, a four-sided round-wire ring via a system of channels for reliable movement to which a truss catch (flat hook) is attached to the end of a one-piece strap which is also adjustable by virtue of a slide ring.

DETAILED DESCRIPTION OF THE PREFERRED EMBODIMENTS

Figure 1:
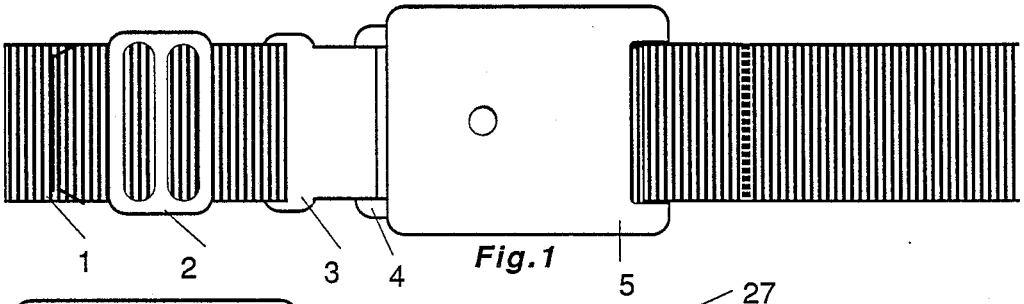
FIG. 1 illustrates a posture monitor of the present invention.

FIG. 1 shows the one-piece continuous belt 1 looped through the truss catch 3 and fastened to the slide ring 3 which controls the length and tightness of the belt. When worn, the truss catch is hooked on to the movable four-sided round-wire ring which slides in and out of the housing 5 as the waist expands and contracts.

Figure 2:
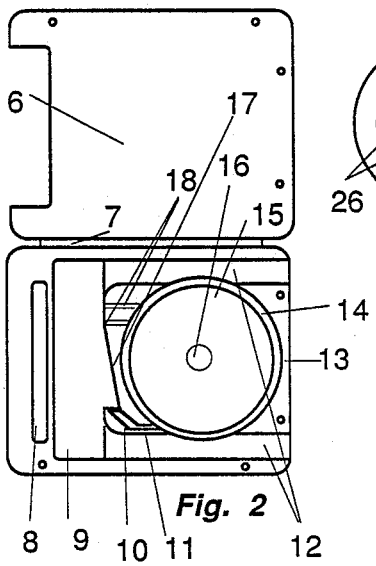
FIG. 2 illustrates the one-piece housing.

FIG. 2 shows the housing with its integral cover 6 in its open position. Living hinge 7 connects cover to main housing. The other end of the belt goes throught the slot 8 where it folds around and sewn together with itself. 9 is a cavity where one of the shorter side of the four-sided round-wire ring 30 (see FIG. 6) and leaf spring 27 (see FIG. 4) float in. Its depth is about 20 percent greater than the width of the of the leaft spring to prevent leaf spring from scraping the bottom of the cavity. 10 is a slit about 45 degrees with the long end of the housing with depth equal to or 10 percent greater than the width of the leaf spring to hold one leaf spring (or more to increase bias force) and the formed uninsulated solid hook-up wire 29 squeezed in together and kept in place by cover 6. 10 is so positioned so that the longitudinal center leaf spring is registered with the longitudinal center of the short leg of the four-sided round-wire ring which is made of a heavy round wire. Wire slit 11 keeps formed hook-up wire 29 in place and below the top plane of the circular sound module holder 13. Sound module holder has a diameter equal to the diameter of the brass disc 19 so that the sound module (see FIG. 3) simply snaps in and held in place by friction. Channels 12 with closed cover 6 assures smooth sliding of the parallel legs of the four-sided round-wire ring. Their depths and widths are each equal to the diameter of the wire of the four-sided round-wire ring plus a few thousands of an inch to assure smooth movement. 14 is an integral circular spacer with the housing to keep the vibrating brass disc of the sound module from touching the integral diaphragm 15. Hole 16 is provided in the diaphragm for the sound to pass through. The outside wall of sound module holder 13 at 17 is cut at an angle of about 15 degrees from vertical to prevent leaf spring from overbending. Parallel wire slits 18 hold the formed uninsulated solid hook-up wire 28, the depths of which are each equal to one half the width of the leaf spring to assure registration with the longitudinal center of the leaf spring.

Figure 3:
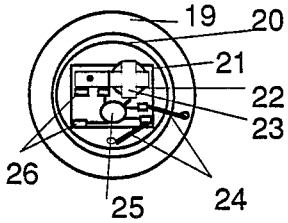
FIG. 3 illustrates the electronic piezoceramic sound module.
Figure 4:
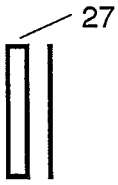
FIG. 4 illustrates the front and profile views of the leaf spring.
Figure 5:
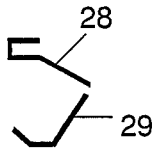
FIG. 5 illustrates the solid uninsulated hook-up wires that connects to the power circuit of the sound module.

FIG. 3 shows the piezoceramic sound module with its components. Brass disc 19 and piezo wafer 20 together make the piezoceramic sound element. On top of the piezoceramic element is bonded via a double sided tape the printed circuit board 21 which holds the button battery 22 via its holder 23, the audio outputs leads 24 soldered to the piezoceramic element the microchip 25 and power circuit soldering tabs 26.

Figure 6:
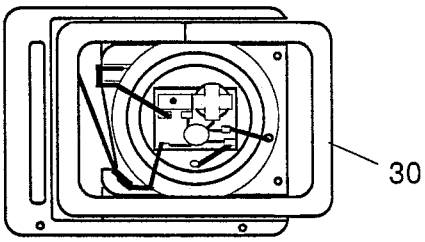
FIG. 6 illustrates the housing with the inside components in place.

FIG. 6 shows all the internal components in place with formed leads 28 and 29 soldered to solder tabs 26, and four-sided round-wire ring 30 nestled in the channels.

Figure 7:
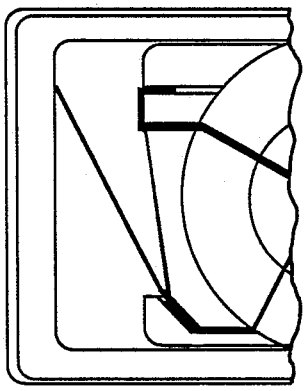
FIG. 7 illustrates the close-up view of the switching arrangement in the off position.

FIG. 7 shows the power off position. This is when the waist is pulled in and therfore the belt is loose and the leaf spring 27 pulls the four-sided round-wire ring 30 away from the hook-up wire 28.

Figure 8:
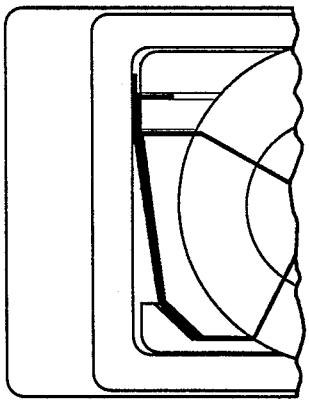
FIG. 8 illustrates the closed-up view of the switching arrangement in the on position.

FIG. 8 shows the power on position with the sound module beeping. The waist is expanded and the belt is pulling the four-sided round-wire ring 30 and the leaf spring 27 on to the hook-up wire 28.

Figure 9:
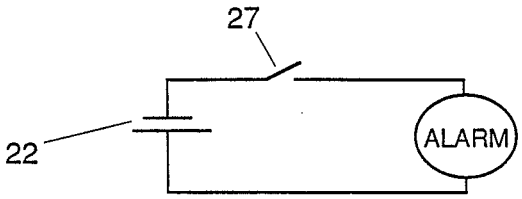
FIG. 9 illustrates the circuitry of the device.

FIG. 9 shows the circuit connection of the alarm device.

I claim:

1. An alarm device to indicate the expansion of the wearer's waist and used in conjunction with a belt, said alarm device comprising:

(a) a hollow housing with a channel to accommodate the movement of a leg of a four-sided round-wire ring and a pair of parallel channels extending through a side of the housing to accommodate the sliding to and fro of the remaining two parallel legs of said wire ring;

(b) an alarm, and (c) an electrical circuit means for coupling electrical power to said alarm employing a leaf spring system which acts like the conductive armature of a normally off switch, said leaf spring system consisting of a leaf spring or a plurality of leaf springs stacked together and held together in one common anchor point in the said housing with a first hook up wire to which said leaf spring system is electrically connected, said leaf spring system being oriented away from a second hook-up wire which is connected in series with a battery, said alarm, said first hook-up wire and the other end of said leaf spring system, whereby tension in said belt causes said four-sided round-wire ring to push said leaf spring system to touch said second hook-up wire, thus completing said circuit means and turning on said alarm.

2. An alarm device as set forth in 1 wherein the said conductors are made of uninsulated hook-up wire one of which is formed to the shape of a dipper whose sides of the scoop are parallel, and the other a wide mouth dipper whose sides of the scoop are angled at each other.

3. An alarm device as in claim 2 wherein said formed conductors are held in place and secured in the said housing by two pairs of slits to accommodate the shape of the conductors; a first pair being a pair of parallel slits, a second pair being made of two slits angled towards and connected to each other, one of the slits providing a conduit for a conductor, another connecting slit being wider than said one slit to hold said conductor and the leaf spring system securely and electrically together; said slits being located in a wall that holds a piezoceramic sound module in place inside the housing; and said slits being spaced apart but registered with each other, with the leaf spring and with the wire ring.

4. An alarm device as in claim 1 wherein said leaf spring system maintains its elasticity without reaching the irreversible bent state, rests on one of the legs of the wire ring at an angle when the wire is pulled all the way into the housing, and continues to be at angle with the said leg even when the leaf spring is at electrically closed circuit position, this condition being ensured by the angled orientation of a slit to where a portion of the leaf spring is anchored and the angled orientation of a wall with respect to the said leg on which the leaf spring rests when the wire ring is at maximum pull position.

5. An alarm device as in claim 1 fastened to the wearer's waist by a belt, a truss catch (flat hook) and a slide ring to adjust the length and tightness of the belt.

6. An alarm device as in claim 1 wherein said housing comprises:

(a) a slot on one side to which one end of the belt is secured; and (b) a system of parallel channels extending from within the housing and into the outside of the housing to accommodate two parallel legs of the four-sided ring; said housing having a cavity to accodmmodate the movement of one of the other remaining legs.

7. An alarm device as in claim 1 wherein said housing has an integrated snap-in cavity to hold a piezoceramic sound module.

8. An alarm device as in claim 1 wherein said housing has an integrated diaphragm to amplify sound produced by a piezoceramic sound module.

9. An alarm device as in claim 1 wherein said housing is a one-piece clam-type construction wherein the housing container and housing cover are connected to each other by a "living hinge", said housing further held closed by several peg-hole pairs on the container and cover housing.

10. An alarm device as in claim 1 containing an alarm, said alarm comprising:

(a) piezoceramic/brass disc system;

(b) miniature botton-type battery; and (c) microchip oscillator and amplifier circuitry secured on to the printed circuit board by epoxy; wherein (d) said printed circuit board holding the battery, the battery holder, microchip and audio output hook-up wires is fastened on top of the piezoceramic/-brass disc system by double-sided adhesive tape or double-sided adhesive foam or glue.

11. An alarm device to indicate expansion of the wearer's waist and used in conjunction with a belt, said alarm device comprising:

(a) a hollow housing;

(b) a member with at least four sides nestled in the said housing, said housing having one or more channels extending from within the housing into the outside of the housing to accommodate sliding of the said member;

(c) an alarm;

(d) a leaf spring with said housing for pulling said member into the said housing; and (e) an electrical circuit means for coupling electrical power to said alarm when said member pulls said leaf spring outward to a predetermined position, said electrical circuit means comprising said leaf spring and two conductive wires held in place in the housing and spaced from and in registry with each other via the leaf spring such that when the leaf spring reaches the predetermined position it completes the circuit created by the two conductors.

* * * * *